US009353991B2

(12) United States Patent
Jensen

(10) Patent No.: US 9,353,991 B2
(45) Date of Patent: May 31, 2016

(54) PIVOTING CENTER HANGER FOR A GRAIN STIRRING DEVICE

(71) Applicant: SUKUP MANUFACTURING CO., Sheffield, IA (US)

(72) Inventor: Thomas J. Jensen, Sheffield, IA (US)

(73) Assignee: Sukup Manufacturing Co., Sheffield, IA (US)

( * ) Notice: Subject to any disclaimer, the term of this patent is extended or adjusted under 35 U.S.C. 154(b) by 0 days.

(21) Appl. No.: 14/594,870

(22) Filed: Jan. 12, 2015

(65) Prior Publication Data

US 2015/0196883 A1 Jul. 16, 2015

Related U.S. Application Data

(60) Provisional application No. 61/926,601, filed on Jan. 13, 2014.

(51) Int. Cl.

| | |
|---|---|
| ***B01F 7/00*** | (2006.01) |
| ***F26B 9/08*** | (2006.01) |
| ***F26B 25/04*** | (2006.01) |

(52) U.S. Cl.

CPC ..... *F26B 9/085* (2013.01); *F26B 25/04* (2013.01)

(58) Field of Classification Search

CPC ..... B01F 7/419; B01F 7/302; B01F 7/1655; B01F 7/30; G01F 7/00975

USPC ..... 366/261

See application file for complete search history.

(56) References Cited

U.S. PATENT DOCUMENTS

| | | | | | |
|---|---|---|---|---|---|
| RE21,811 | E | * | 5/1941 | Kepper | B01D 21/06 210/528 |
| 3,295,835 | A | * | 1/1967 | Klopper | B01D 21/0003 159/33 |
| 3,580,549 | A | * | 5/1971 | Murphy | F26B 9/085 366/261 |
| RE27,931 | E | * | 2/1974 | Sukup | B65D 88/742 366/261 |
| 4,162,857 | A | * | 7/1979 | Spurling | B01F 7/302 366/261 |
| 4,340,310 | A | * | 7/1982 | Clark | A23B 9/00 200/52 R |
| 4,836,686 | A | | 6/1989 | Sukup | |
| 4,854,719 | A | | 8/1989 | Sukup | |
| 5,474,380 | A | * | 12/1995 | Sukup | B01F 7/302 239/63 |
| 5,570,954 | A | * | 11/1996 | Sukup | F26B 9/085 366/261 |
| 6,851,847 | B2 | | 2/2005 | Sukup | |
| 6,948,902 | B2 | * | 9/2005 | Hanig | B65G 65/466 198/518 |

OTHER PUBLICATIONS

"Stir-Rite: The Leading Grain Stirring Machine," pp. 1-4, NECO.
"Smartstir: Efficient, Robust & Reliable," pp. 1-4, NECO.
"Sukup Stirring Machines: Fastir," Mar. 2014, pp. 1-4, Sukup Manufacturing Co.
"Sukup Stirring Machines: Fastir," Dec. 2010, pp. 1-4, Sukup Manufacturing Co.

* cited by examiner

*Primary Examiner* — Shin Kim
(74) *Attorney, Agent, or Firm* — Zarley Law Firm, P.L.C.

(57) ABSTRACT

A pivoting center hanger for a grain stirring machine has a top plate connected to a vertical member. A pair of braces are connected to and extend between the top plate and the vertical member. Pivotally connected to the vertical member is a base member that permits a gear motor shaft and a cross tube shaft to stay in alignment when the cross tube shaft bows downwardly.

8 Claims, 2 Drawing Sheets

PIVOTING CENTER HANGER FOR A GRAIN STIRRING DEVICE

CROSS REFERENCE TO RELATED APPLICATION

This application claims the benefit of U.S. Provisional Application No. 61/926,601 filed Jan. 13, 2014.

BACKGROUND OF THE INVENTION

This invention is directed to a center hanger for a grain stirring device and more particularly to a center hanger that pivots.

Grain stirring devices are well-known in the art for use in eliminating over dried grain as well as reducing drying time and cost. A center hanger, which hangs from the roof of a grain bin, supports the stirring device within the bin.

Presently, center hangers have a vertical member and a horizontal base that are welded at a fixed 90 degree angle to one another. As a result, when additional load is placed upon the stirring auger, the cross tube bows downwardly in the middle placing stress on the connection between the cross tube shaft and a gear motor shaft. The stress leads to wear, and eventual damage such as shearing of pins, and break down of the gear motor. Therefore, a need exists in the art for a device that addresses this deficiency.

An objective of the present invention is to provide a center hanger that reduces stress on the connection between a cross tube shaft and a gear motor shaft.

Another objective of the present invention is to provide a center hanger where a base member pivots in relation to a vertical member.

These and other objectives will be apparent to one of ordinary skill in the art based upon the following written description, drawings, and claims.

SUMMARY OF THE INVENTION

A pivoting center hanger for a grain stirring machine has a top plate connected to a vertical member. A pair of braces are connected to and extend between the top plate and the vertical member. Pivotally connected to the vertical member is a base member that permits a gear motor shaft and a cross tube shaft to stay in alignment when the cross tube bows downwardly.

DETAILED DESCRIPTION OF THE PREFERRED EMBODIMENTS

Figure 1:
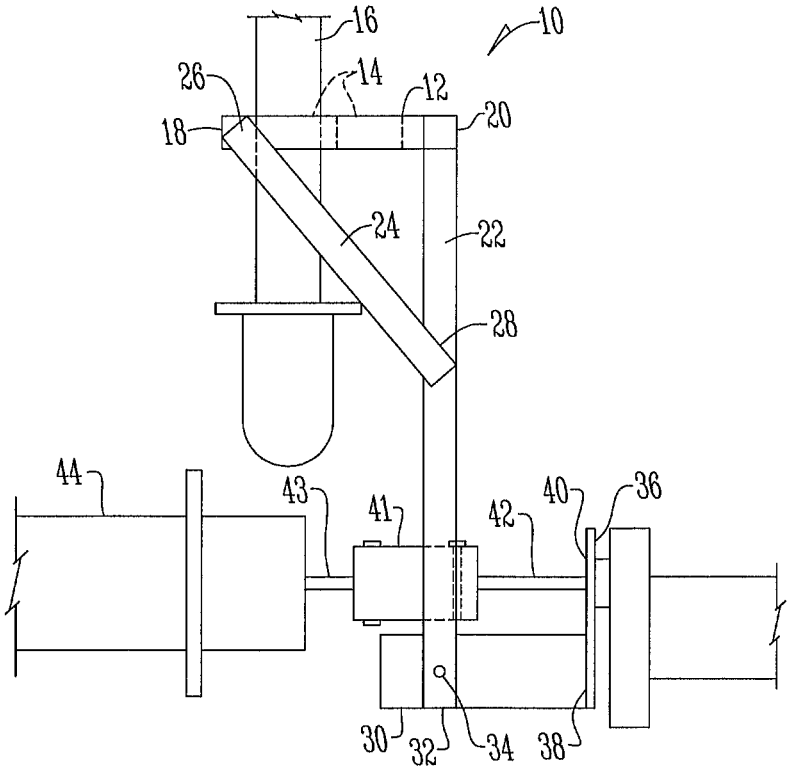
FIG. 1 is a side view of a center hanger for a grain stirring device.
Figure 2:
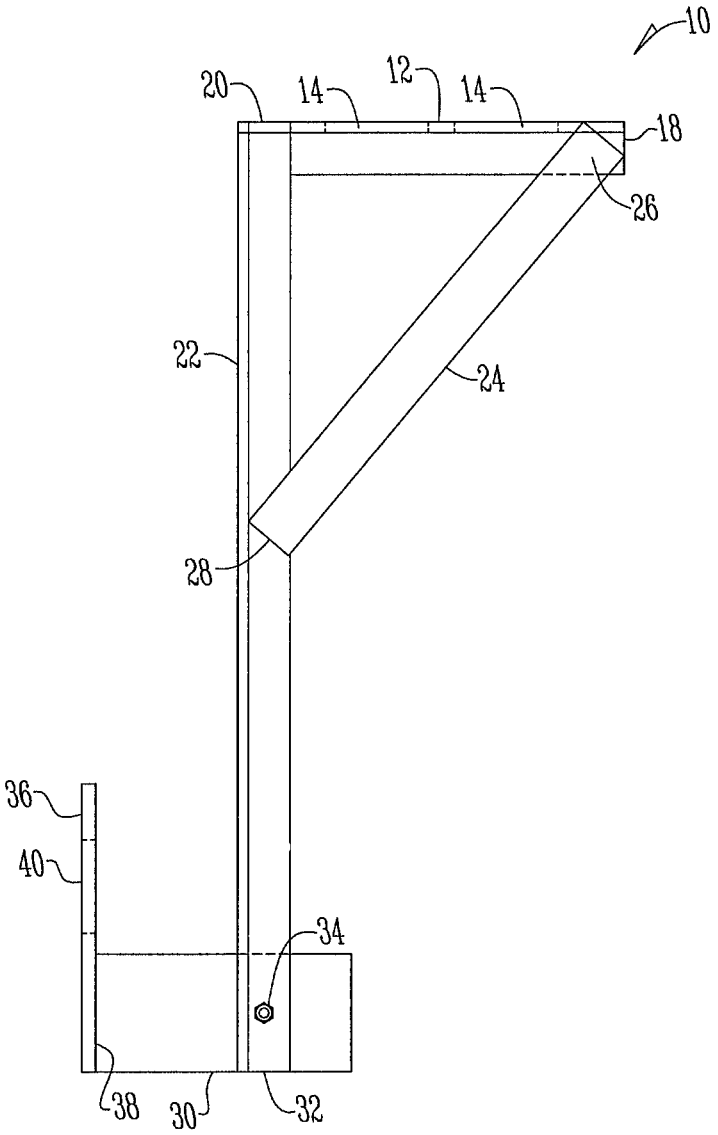
FIG. 2 is a side view of a center hanger for a grain stirring device.

Referring to the Figures, a pivoting center hanger 10 has a connecting or top plate 12 having a plurality of apertures 14 that receive and is rotatably connected to a support 16 that is operatively connected to the roof of a grain bin. The top plate 12 has a first end 18 and a second end 20 and generally dwells in a horizontal plane.

A pair of vertical members 22 are connected to the second end 20 of the top plate 12 and extend downwardly from the top plate 12 in a generally perpendicular relation. Preferably the vertical members are welded to the second end 20 of the top plate 12.

A pair of support braces 24 are attached to opposite sides of the hanger 10 and are connected at a first end 26 to the first end 18 of the top plate 12 and to the vertical members 24 at a second end 28.

A horizontal base member 30 is pivotally connected to ends 32 of the vertical members 22 by at least one of a preferably pair of pivot bolts or pins 34. The base member 32 has a mounting plate 36 connected to one end 38 that extends upwardly from the base member 32 in a generally perpendicular manner. The mounting plate 36 has an aperture 40. Aperture 40 receives a gear motor shaft 42 that extends through a coupling 41 and is operatively connected to cross tube shaft 43.

In operation, as additional load is encountered by the stirring augers (not shown) the middle of the cross tube 44 tends to bow downwardly. When this occurs, the base member 32 pivots about bolts 34 and in relation to the vertical member 22 such that the gear motor shaft 42 and the cross tube shaft 43 remain longitudinally aligned regardless of the deflection of the cross tube 44 caused by the vertical load on the stirring auger. As a result, less stress, wear and damage occur at the coupling 41 where connection between the motor shaft 42 and the cross tube shaft 43 occurs.

Therefore, a pivoting center hanger has been disclosed that at the very least meets the stated objectives.

What is claimed is:

1. A center hanger for a grain stirring device; comprising:
- a top plate having a first end and a second end;
- a pair of vertical members connected to the second end of the top plate and extending downwardly in a generally perpendicular direction in relation to the top plate;
- a pair of support braces connected to and extending between the top plate and the vertical member; and
- a base member having a mounting plate with an aperture for receiving a gear motor shaft that is pivotally connected to the vertical member.

2. The hanger of claim 1 wherein the base member is pivotally connected to the vertical member by a pair of bolts.

3. The hanger of claim 1 wherein when an excess load is encountered the base member pivots such that the gear motor shaft and a cross tube shaft remain longitudinally aligned.

4. The hanger of claim 3 wherein the gear motor shaft and the cross shaft extend through a coupling and are operatively connected.

5. The hanger of claim 1 wherein the base member is pivotally connected to at least one vertical member by at least one bolt received through at least one vertical member and the base member.

6. A center hanger for a grain stirring device; comprising:
- a top plate;
- at least one vertical member connected to the top plate and extending downwardly in relation to the top plate;
- at least one support brace connected to and extending between the top plate and the at least one vertical member; and
- a base member having a mounting plate for receiving a gear motor shaft that is pivotally connected to the at least one vertical member.

7. The hanger of claim 6 wherein the base member is connected to the at least one vertical member by at least one bolt received through the at least one vertical member and the base member.

8. The hanger of claim 6 wherein when an excess load is encountered the base member pivots such that the gear motor shaft and a cross tube shaft remain longitudinally aligned.

* * * * *